US010584538B2

(12) United States Patent
Hird et al.

(10) Patent No.: US 10,584,538 B2
(45) Date of Patent: Mar. 10, 2020

(54) REAMER

(71) Applicant: SCHLUMBERGER TECHNOLOGY CORPORATION, Sugar Land, TX (US)

(72) Inventors: Jonathan Robert Hird, Cambridge (GB); Ashley Bernard Johnson, Cambridge (GB); Gokturk Tunc, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/328,051

(22) PCT Filed: Jul. 21, 2015

(86) PCT No.: PCT/US2015/041224
§ 371 (c)(1),
(2) Date: Jan. 22, 2017

(87) PCT Pub. No.: WO2016/014449
PCT Pub. Date: Jan. 28, 2016

(65) Prior Publication Data

US 2017/0211334 A1 Jul. 27, 2017

(30) Foreign Application Priority Data

Jul. 21, 2014 (GB) ..... 1412934.0

(51) Int. Cl.
*E21B 10/32* (2006.01)
*E21B 10/43* (2006.01)
(Continued)

(52) U.S. Cl.
CPC ..... *E21B 10/322* (2013.01); *E21B 10/43* (2013.01); *E21B 10/46* (2013.01); *E21B 10/567* (2013.01)

(58) Field of Classification Search
CPC ..... E21B 10/322; E21B 10/567; E21B 10/46; E21B 10/43
See application file for complete search history.

(56) References Cited

U.S. PATENT DOCUMENTS 4,431,065 A 2/1984 Andrews
4,499,959 A * 2/1985 Grappendorf ..... E21B 47/18 175/405.1
(Continued)

FOREIGN PATENT DOCUMENTS

CN 102086756 A 6/2011
EP 0385673 A1 9/1990
(Continued)

OTHER PUBLICATIONS

International Search Report and Written Opinion for related Application Serial No. PCT/US2014/068991, dated Mar. 25, 2015, 14 pages.
(Continued)

*Primary Examiner* — Jennifer H Gay

(57) ABSTRACT

A reamer for enlarging an underground borehole comprises a plurality of cutter assemblies distributed azimuthally around a longitudinal axis of the tool, and each cutter assembly comprises a supporting structure and a plurality of hard faced cutters (211-216) embedded therein with a hard face of each cutter exposed and facing in a direction of rotation of the tool. Each cutter assembly includes at least one outward-facing gauge surface (220), at a radial distance from the tool axis which aligns the gauge surface with the radially outer extremity (218) of at least one cutter. This gauge surface (220) extends (221) in the direction of rotation
(Continued)

circumferentially ahead of the extremity of the exposed face of the aligned at least one cutter. It may meet the side of the assembly at a curved (222) or bevelled (342) edge and may also extend back from the exposed face of the cutter. These gauge surfaces aligned with the extremity of the cutter prevent the reamer from pivoting around the extremity of a cutter which has snagged on the borehole wall and thus stabilize the rotation within the borehole.

17 Claims, 13 Drawing Sheets

(51) Int. Cl.
*E21B 10/46* (2006.01)
*E21B 10/567* (2006.01)

(56) References Cited

U.S. PATENT DOCUMENTS 4,515,227 A * 5/1985 Cerkovnik ..... E21B 10/26 175/385
4,593,777 A 6/1986 Barr
4,710,074 A 12/1987 Springer
4,887,668 A 12/1989 Lynde et al.
5,341,888 A 8/1994 Deschutter
5,967,247 A 10/1999 Pessier
6,732,817 B2 * 5/2004 Dewey ..... E21B 7/067
6,880,650 B2 4/2005 Hoffmaster et al.
6,920,923 B1 7/2005 Pietrobelli et al.
7,467,671 B2 12/2008 Savignat et al.
7,506,703 B2 * 3/2009 Campbell ..... E21B 10/322 175/263
7,571,782 B2 * 8/2009 Hall ..... E21B 10/43 175/425
7,726,415 B1 * 6/2010 Tipton ..... E21B 10/26 175/385
7,954,564 B2 * 6/2011 Makkar ..... E21B 10/322 175/263
7,963,348 B2 6/2011 Laird et al.
7,975,783 B2 7/2011 Fanuel et al.
8,205,689 B2 6/2012 Radford
8,297,381 B2 10/2012 Radford et al.
8,517,124 B2 * 8/2013 Hareland ..... E21B 10/62 175/393
8,550,188 B2 10/2013 Makkar et al.
8,752,649 B2 6/2014 Isenhour
8,776,912 B2 * 7/2014 Makkar ..... E21B 7/28 175/263
8,905,126 B2 12/2014 Krieg et al.
9,051,793 B2 * 6/2015 Makkar ..... E21B 10/322
9,068,407 B2 6/2015 Radford et al.
9,074,434 B2 * 7/2015 Mensa-Wilmot ..... E21B 10/43
9,187,958 B2 * 11/2015 Mensa-Wilmot ..... E21B 7/28
9,359,825 B2 6/2016 Gavia et al.
9,593,538 B2 3/2017 Rasheed
9,739,094 B2 * 8/2017 Moreno, II ..... E21B 10/26
2001/0020552 A1 9/2001 Beaton et al.
2003/0029644 A1 2/2003 Hoffmaster et al.
2003/0155155 A1 * 8/2003 Dewey ..... E21B 7/067 175/57
2004/0188149 A1 9/2004 Thigpen et al.
2004/0222022 A1 11/2004 Nevlud et al.
2005/0034897 A1 2/2005 Youan
2007/0089912 A1 4/2007 Eddison et al.
2007/0163808 A1 * 7/2007 Campbell ..... E21B 10/322 175/57
2007/0205024 A1 * 9/2007 Mensa-Wilmot ..... E21B 10/43 175/408
2007/0272446 A1 * 11/2007 Mensa-Wilmot ..... E21B 10/43 175/331
2008/0149396 A1 6/2008 Fyfe
2008/0190670 A1 * 8/2008 Welch ..... E21B 10/43 175/430
2008/0314645 A1 * 12/2008 Hall ..... E21B 10/43 175/374
2009/0294173 A1 12/2009 Laird et al.
2009/0294178 A1 12/2009 Radford
2009/0321138 A1 * 12/2009 Shamburger ..... E21B 10/43 175/61
2010/0012387 A1 * 1/2010 Huynh ..... E21B 10/43 175/428
2010/0018779 A1 * 1/2010 Makkar ..... E21B 10/322 175/382
2010/0051349 A1 * 3/2010 Ballard ..... E21B 10/26 175/57
2010/0089649 A1 * 4/2010 Welch ..... E21B 10/43 175/61
2010/0224414 A1 * 9/2010 Radford ..... E21B 10/322 175/57
2010/0263875 A1 10/2010 Williams et al.
2010/0276201 A1 * 11/2010 Makkar ..... E21B 7/28 175/57
2011/0005836 A1 1/2011 Radfprd et al.
2011/0005841 A1 1/2011 Wood et al.
2011/0120777 A1 5/2011 Lee
2011/0127087 A1 * 6/2011 Hareland ..... E21B 10/602 175/393
2011/0259650 A1 * 10/2011 Hall ..... E21B 10/43 175/430
2012/0012398 A1 1/2012 Hall et al.
2012/0152543 A1 6/2012 Davis
2012/0205151 A1 8/2012 Inoue et al.
2012/0205157 A1 8/2012 Radford et al.
2012/0255786 A1 10/2012 Isenhour
2013/0075167 A1 * 3/2013 Knull ..... E21B 10/43 175/428
2013/0087386 A1 4/2013 Radford et al.
2013/0146361 A1 * 6/2013 Makkar ..... E21B 10/322 175/57
2013/0199855 A1 8/2013 Shears
2013/0256036 A1 10/2013 Lyons
2013/0341100 A1 * 12/2013 Zhang ..... E21B 10/46 175/375
2014/0008128 A1 * 1/2014 Adam ..... E21B 10/32 175/57
2014/0048335 A1 * 2/2014 Mensa-Wilmot ..... E21B 7/28 175/263
2014/0048336 A1 * 2/2014 Mensa-Wilmot ..... E21B 10/32 175/266
2014/0262523 A1 9/2014 Davis
2015/0068813 A1 * 3/2015 Moreno, II ..... E21B 10/26 175/263
2015/0144405 A1 * 5/2015 Salvo ..... E21B 10/322 175/263
2016/0290067 A1 * 10/2016 Tipples ..... E21B 17/1078
2016/0305190 A1 10/2016 Johnson et al.
2017/0058611 A1 * 3/2017 Lin, Jr. ..... E21B 10/43
2017/0204670 A1 * 7/2017 Hird ..... E21B 10/322
2017/0211332 A1 * 7/2017 Hird ..... E21B 10/322
2017/0211333 A1 * 7/2017 Hird ..... E21B 10/322
2017/0211334 A1 * 7/2017 Hird ..... E21B 10/322
2017/0211335 A1 * 7/2017 Hird ..... E21B 10/43
2017/0218707 A1 * 8/2017 Hird ..... E21B 10/567
2018/0094496 A1 * 4/2018 Su ..... E21B 29/002

FOREIGN PATENT DOCUMENTS

EP 0397417 A1 11/1990
EP 0869256 A2 10/1998
EP 1811124 A1 7/2007
EP 2097610 A1 9/2009
GB 2417267 A 2/2006
GB 2520998 A 6/2015
WO 9937881 A2 1/2000
WO 03102354 A1 12/2003
WO 2004101943 A2 11/2004
WO 2005047644 A1 5/2005
WO 2005052301 A2 6/2005
WO 2007041811 A1 4/2007
WO 2008100194 A2 8/2008

(56) References Cited

FOREIGN PATENT DOCUMENTS

| | | | |
|---|---|---|---|
| WO | 2010126938 | A2 | 11/2010 |
| WO | 2013134629 | A1 | 9/2013 |
| WO | 2013167954 | A2 | 11/2013 |
| WO | 2014028457 | A1 | 2/2014 |
| WO | 2014150524 | A2 | 9/2014 |
| WO | 2014159079 | A1 | 10/2014 |
| WO | 2015054227 | A2 | 4/2015 |

OTHER PUBLICATIONS

Search Report under Section 17 of UK Patent Application No. 1412934.0, dated Jan. 16, 2015, 4 pages.
Exam Report under Section 18(3) of UK Patent Application No. 1412934.0, dated Sep. 2, 2016, 2 pages.
Search Report and Written Opinion of International Patent Application No. PCT/US2015/041260, dated Oct. 19, 2015, 11 pages.
Search Report under Section 17(5) of UK Patent Application No. 1412933.2, dated Dec. 22, 2015, 4 pages.
Search Report under Section 17(5) of UK Patent Application No. 1412932.4, dated Jan. 16, 2015, 3 pages.
Exam Report under Section 18(3) of UK Patent Application No. 1412932.4, dated Jan. 23, 2018, 4 pages.
Exam Report under Section 18(3) of UK Patent Application No. 1412932.4, dated Nov. 18, 2016, 5 pages.
Search Report and Written Opinion of International Patent Application No. PCT/US2015/041265, dated Oct. 8, 2015, 12 pages.
Search Report under Section 17(5) of UK Patent Application No. 1412932.4, dated Jan. 12, 2015, 3 pages.
Search Report and Written Opinion of International Patent Application No. PCT/US2015/041223, dated Oct. 19, 2015, 11 pages.
Search Report under Section 17(5) of UK Patent Application No. 1412929.0, dated Jan. 12, 2015, 3 pages.
Combined Search and Exam Report under Sections 17 and 18(3) of UK Patent Application No. 1321625.4, dated Nov. 25, 2015, 8 pages.
Search Report and Written Opinion of International Patent Application No. PCT/US2015/041280, dated Oct. 13, 2015, 12 pages.
Combined Search and Exam Report under Sections 17 and 18(3) of UK Patent Application No. 1412930.8, dated Jan. 12, 2015, 5 pages.
Search Report and Written Opinion of International Patent Application No. PCT/US2015/040295, dated Oct. 12, 2015, 12 pages.
Combined Search and Exam Report under Sections 17 and 18(3) of UK Patent Application No. 1321625.4, dated May 7, 2014, 5 pages.
European Search Report of EP Patent Application No. 14868423.6, dated Nov. 23, 2016, 3 pages.
European Exam Report of EP Patent Application No. 14868423.6, dated Jan. 3, 2017, 5 pages.
Office Action issued in U.S. Appl. No. 15/102,039, dated Jun. 1, 2018, 15 pages.

* cited by examiner

REAMER

BACKGROUND

One practice which may be employed when drilling a borehole is to enlarge a hole with a reamer. A reamer may be constructed to have a fixed diameter, in which case the reamer must start cutting at the surface or at the end of an existing hole of equal or greater size. Alternatively a reamer can be constructed so as to be expandable so that it can enlarge a borehole to a greater diameter than that of the hole through which the (unexpanded) reamer was inserted.

Enlarging a borehole with a reamer may be done as a separate operation to enlarge an existing borehole drilled at an earlier time. Enlarging with a reamer may also be done at the same time as using a bottom hole assembly which has a drill bit at its bottom end. The drill bit makes an initial hole, sometimes referred to as pilot hole, and a reamer positioned at some distance above the drill bit increases the whole diameter.

There is more than one type of reaming tool. Some reamers are constructed to be eccentric, relative to the drill string to which they are attached and the borehole which they are enlarging. Other reamers are constructed to remain concentric with the drill string and the borehole. These different types of reamers tend to be used in different circumstances. There are many instances where concentric reamers are the appropriate choice.

A reamer may have a plurality of cutter assemblies, each comprising a support structure with attached cutters, arranged azimuthally around the axis of the tool. In the case of an expandable reaming tool it is common to have a plurality of radially expandable support elements bearing cutters positioned around the axis of the tool. Often the tool has three such cutter assemblies which extend axially and are arranged at 120° intervals azimuthally around the tool axis. A mechanism is provided for expanding these cutter assemblies radially outwardly from the axis and this mechanism typically uses hydraulic pressure to force the support structures of the cutter assemblies outwardly.

This tool construction has commonly been used for concentric reamers. In some constructions, each of the individual cutter assemblies arranged around the tool axis is an assembly of parts attached together so as to move bodily as one piece, in which case the assembly is often referred to as a "block" (one part of this assembly may be a shaped monolithic block) although the term "arm" has also been used for such an assembly. The individual cutter assemblies (i.e. individual blocks) may be moved outwards in unison by one drive mechanism acting on them all, or may be moved outwards by drive mechanism(s) which does not constrain them to move in unison.

Cutters attached to the supporting structure may be hard faced and may be PDC cutters having body with a polycrystalline diamond section at one end. The body may be moulded from hard material such as tungsten carbide particles infiltrated with metallic binder. The polycrystalline diamond section which provides the cutting part may then comprise particles of diamond and a binder. In many instances, the polycrystalline diamond section is a disc so that the hardest end of a cutter is a flat surface but other shapes can also be used.

Reamer designs customarily position at least some cutters with their cutting faces at the leading face of a support structure and with the cutters projecting radially outwardly from the support structure. The parts of the cutter which project outwardly beyond the support structure may be the parts of the cutter principally involved in cutting as the rotating reamer is advanced and/or as an expandable reamer is expanded.

The greatest radius swept by a reamer (so-called full gauge) may be the radial distance from the axis to the extremity of the outermost cutter(s). In order to position a reamer centrally in the reamed bore, it is customary for a supporting structure to include a section which does not include cutters but has a so-called gauge pad (alternatively spelt "gage pad") which is a surface positioned to confront and slide on the wall of the reamed bore. In an expandable reamer, it is known to position gauge pads at a radius which is slightly less than full gauge so as to facilitate cutting during the period when the reamer is being expanded.

It is desirable that a reamer maintains stable cutting behaviour, centred on the axis of the existing bore, even though it has significant mass of collars and other drill string components placed above and/or below it. Yet frontal area in frictional contact with the formation, which helps to dampen oscillations, is smaller than with a drill bit of the same diameter. It has been observed that reamers tend to be more prone to the phenomenon of whirling than are drill bits. In this context, whirling refers to a motion in which the tool axis moves around a centre line rather than staying on it, leading to a miss-shaped or oversized borehole.

SUMMARY

This summary is provided to introduce a selection of concepts that are further described below. This summary is not intended to be used as an aid in limiting the scope of the subject matter claimed.

In one aspect, the subject matter disclosed here provides a reaming tool for enlarging an underground borehole, comprising a plurality of cutter assemblies distributed azimuthally around a longitudinal axis of the tool, wherein each cutter assembly comprises a supporting structure and a plurality of hard faced cutters secured therein with a hard face of each cutter at least partially exposed and facing in a direction of rotation of the tool, each cutter assembly includes at least one outward-facing gauge surface at a radial distance from the tool axis which aligns the gauge surface with the radially outer extremity of at least one cutter, and wherein the said gauge surface extends in the direction of rotation circumferentially ahead of the extremity of the exposed face of the aligned at least one cutter.

This constructional arrangement helps to keep the tool stable within the borehole which is being enlarged. It is applicable to reamers of fixed diameter and also to reamers which are expandable. Cutters may be at least partially embedded in the support structure.

Without limitation as to theory, the inventors believe that a radially projecting part of the cutter, at or near its radial extremity, can snag on the borehole wall and become a pivot point. If the reamer then turns bodily around this pivot point it may cease to be centred within the borehole. Providing the gauge surface ahead of the extremity reduces the opportunity for this to occur.

When a cutter assembly has a planar side face, cutters may be positioned with their leading faces set back from the side face of cutter assembly. The gauge surface which extends forwardly beyond the cutters may extend up to the plane of the side surface of the cutter assembly, or may extend only as far as an intermediate point part way between the cutter extremities and the plane of the side face.

A surface extending forwardly ahead of the radial extremities of cutters may be provided between adjoining cutters in a sequence of cutters, or may be provided as part of the gauge surface on a length of cutter assembly which does not include cutters and which may be a stabilising pad.

To further mitigate any snagging of the cutter assembly as the tool rotates, a right angled edge where the gauge surface meets the side of the cutter assembly may be avoided. The gauge surface and a side face of the cutter assembly may connect through an inclined or an arcuate surface at the edge.

Cutters used in accordance with the concepts disclosed above may have hard surfaces exposed as the leading faces of the cutters. These hard surfaces may be planar but other shapes, such as a domed or conical shape, are possible. Hard surfaced cutters may be polycrystalline diamond (PDC) cutters which have diamond crystals embedded in a binder material providing a hard face at one end of a cutter body. The radially outer extremity of a cutter may be located at a point at which the circular or other shape of the exposed leading face reaches its maximum distance from the tool axis. However, another possibility is that the cutter is shaped and positioned so that its outer extremity is not a point but is a linear edge parallel to the tool axis or an approximately planar face extending back from such an edge.

Conventional cutter assemblies have sometimes provided cutters in two sequences extending axially along the assembly, one behind the other in the direction of rotation. Within each sequence, each cutter is alongside, but axially spaced from another cutter of the sequence. The inventors have found that good results can be obtained when the cutters of a cutter assembly are arranged as a single sequence of cutters In another aspect, there is disclosed a method of enlarging a borehole by rotating a reaming tool as defined above in the borehole and advancing the tool axially. The method may include expanding a reaming tool which has expandable cutter assemblies and then rotating the tool while also advancing the expanded tool axially.

DETAILED DESCRIPTION

Figure 1:
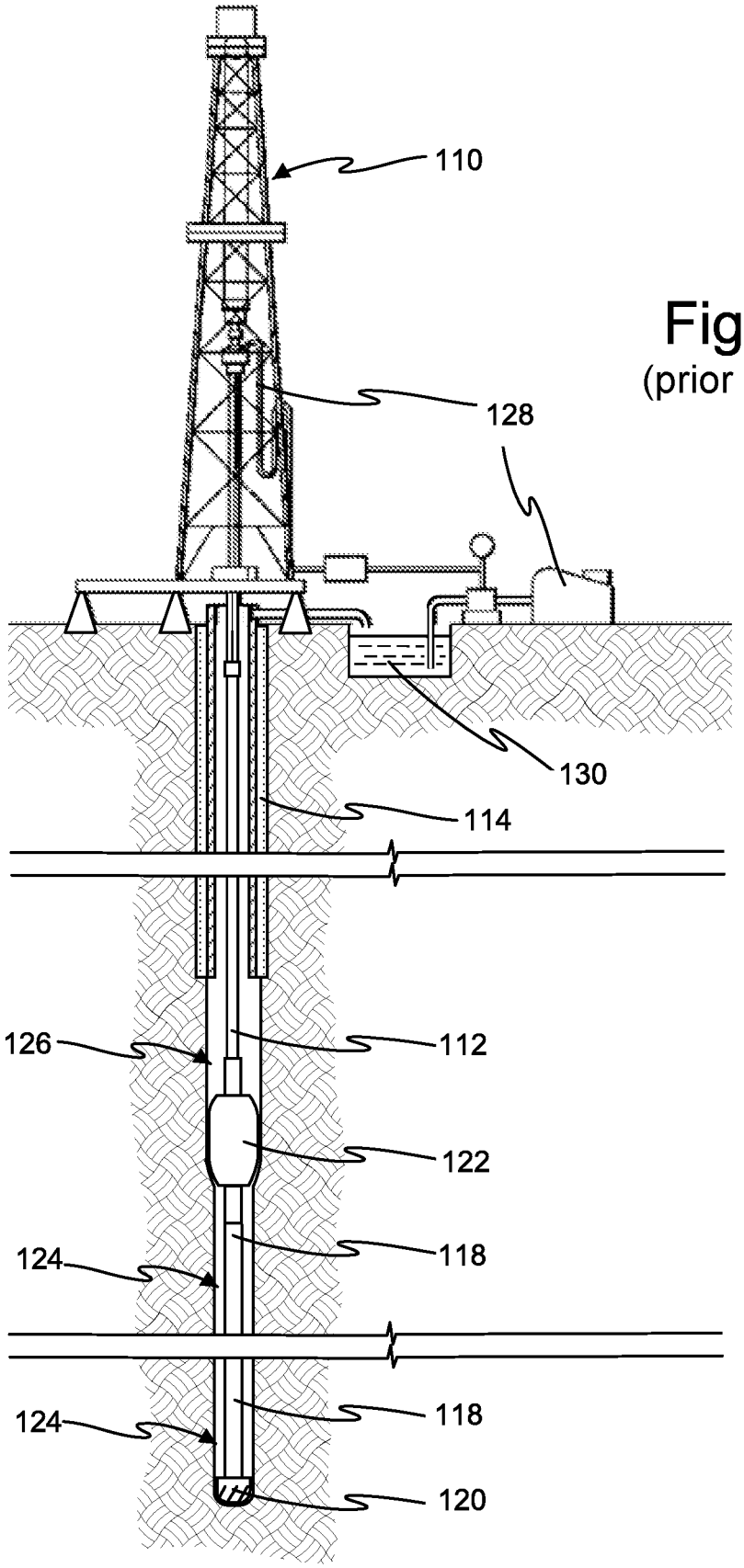
Fig 1 (prior art)
FIG. 1 is a schematic, cross-sectional view of a drilling assembly in a borehole.

FIG. 1 shows an exemplary drilling assembly which includes an expandable under-reamer 122. A drill string 112 extends from a drilling rig 110 into a borehole. An upper part of the borehole has already been lined with casing and cemented as indicated at 114. The drill string 112 is connected to a bottom hole assembly 118 which includes a drill bit 120 and an under-reamer 122 which has been expanded beneath the cased section 114. As the drill string 112 and bottomhole assembly 118 are rotated, the drill bit 120 extends a pilot hole 124 downwards while the reamer 122 simultaneously opens the pilot hole 124 to a larger diameter borehole 126.

The drilling rig is provided with a system 128 for pumping drilling fluid from a supply 130 down the drill string 112 to the reamer 122 and the drill bit 120. Some of this drilling fluid flows through passages in the reamer 122 and flows back up the annulus around the drill string 112 to the surface. The rest of the drilling fluid flows out through passages in the drill bit 120 and also flows back up the annulus around the drill string 112 to the surface. The distance between the reamer 122 and the drill bit 120 at the foot of the bottom hole assembly is fixed so that the pilot hole 124 and the enlarged borehole 126 are extended downwardly simultaneously.

Figure 5:
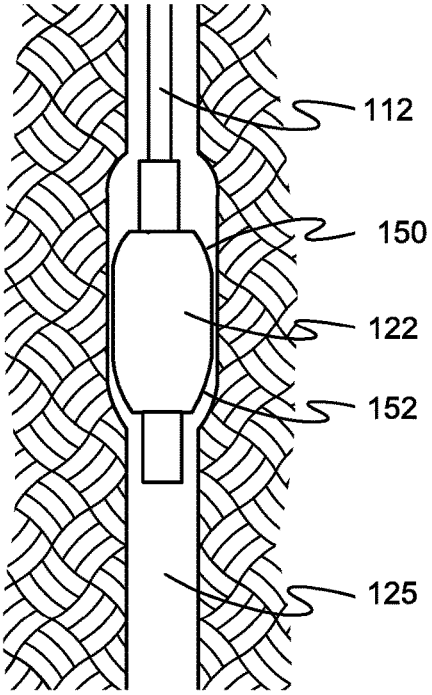
Fig 5 (prior art)
FIG. 5 is a schematic, cross-sectional view of the reamer expanded in a pre-existing borehole.

As shown in FIG. 5, it would similarly be possible to use the same reamer 122 attached to drill string 112, although without the drill bit 120 and the part of the bottom hole assembly 118 below the reamer 122, to enlarge a borehole 125 which had been drilled previously. In FIG. 5, the initial expansion of the reamer has created a fairly short section where the borehole has enlarged diameter. This enlarged portion of the borehole can then be elongated downwardly by advancing the drill string 112 and reamer 122 downwardly.

Figure 2:
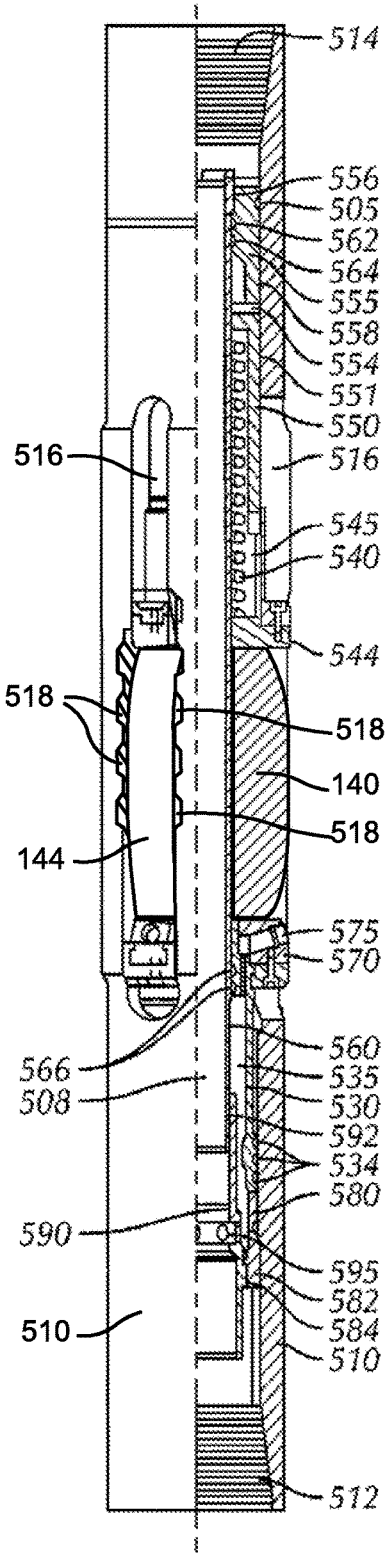
Fig 2 (prior art)
FIG. 2 is a cross-sectional elevation view of one embodiment of expandable reamer, showing its expandable cutter blocks in collapsed position.
Figure 3:
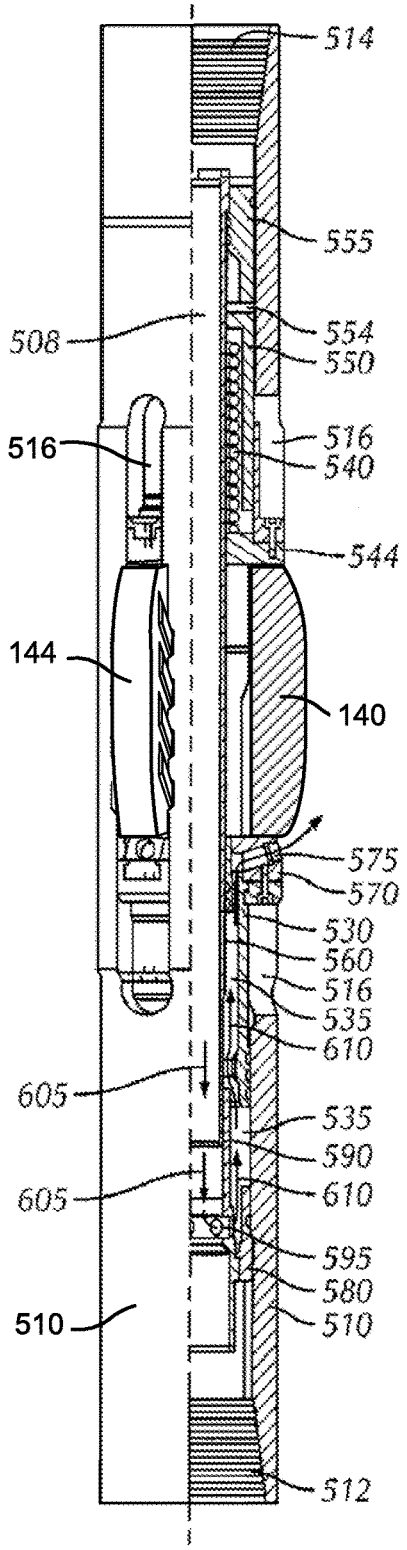
Fig 3 (prior art)
FIG. 3 is a cross-sectional elevation view of the expandable reamer of FIG. 2, showing the cutter blocks in expanded position.

Referring now to FIGS. 2 and 3, one embodiment of expandable reaming tool is shown in a collapsed position in FIG. 2 and in an expanded position in FIG. 3. The expandable tool comprises a generally cylindrical tool body 510 with a central flowbore 508 for drilling fluid. The tool body 510 includes upper 514 and lower 512 connection portions for connecting the tool into a drilling assembly. Intermediately between these connection portions 512, 514 there are three recesses 516 formed in the body 510 and spaced apart at 120° intervals azimuthally around the axis of the tool.

Each recess 516 accommodates a cutter support element 140 in its collapsed position. This support element has the general form of a block to which cutters are attached. One such cutting block 140 is shown in perspective in FIG. 4. The block 140 has an outer face 144 which confronts the wall of the borehole and side faces with protruding ribs 142 which extend at an angle to the tool axis. These ribs 142 engage in channels 518 at the sides of a recess 516 and thus provide a guide mechanism such that when the block 140 is pushed upwardly relative to the tool body 510, it also moves radially outwardly to the position shown in FIG. 3 in which the blocks 140 extend radially outwardly from the tool body 510. The blocks move in unison and so are all at the same axial positions relative to the tool body. Details of the outer face 144 of a block 140 have been omitted from FIGS. 2 and 3.

A spring 540 biases the block 140 downwards to the collapsed position of FIG. 2. The biasing spring 540 is disposed within a spring cavity 545 and covered by a spring retainer 550 which is locked in position by an upper cap 555. A stop ring 544 is provided at the lower end of spring 540 to keep the spring in position.

Below the moveable blocks 140, a drive ring 570 is provided that includes one or more nozzles 575. An actuating piston 530 that forms a piston cavity 535 is attached to the drive ring 570. The piston 530 is able to move axially within the tool. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

The piston 530 sealingly engages the inner mandrel 560 at 566, and sealingly engages the body 510 at 534. A lower cap 580 provides a stop for the downward axial movement of piston 530. This cap 580 is threadedly connected to the body 510 and to the lower retainer 590 at 582, 584, respectively. Sealing engagement is provided at 586 between the lower cap 580 and the body 510.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564.

In operation, drilling fluid flows along path 605, through ports 595 in the lower retainer 590 and along path 610 into the piston chamber 535. The differential pressure between the fluid in the flowbore 508 and the fluid in the borehole annulus surrounding tool 500 causes the piston 530 to move axially upwardly from the position shown in FIG. 2 to the position shown in FIG. 3. A small amount of flow can pass through the piston chamber 535 and through nozzles 575 to the annulus as the tool 500 starts to expand. As the piston 530 moves axially upwardly, it urges the drive ring 570 axially upwardly against the blocks 140. The drive ring pushes on all the blocks 140 simultaneously and moves them all axially upwardly in recesses 516 and also radially outwardly as the ribs 142 slide in the channels 518. The blocks 140 are thus driven upwardly and outwardly in unison towards the expanded position shown in FIG. 3.

The movement of the blocks 140 is eventually limited by contact with the spring retainer 550. When the spring 540 is fully compressed against the retainer 550, it acts as a stop and the blocks can travel no further. There is provision for adjustment of the maximum travel of the blocks 140. The spring retainer 550 connects to the body 510 via a screwthread at 551. A wrench slot 554 is provided between the upper cap 555 and the spring retainer 550, which provides room for a wrench to be inserted to adjust the position of the screwthreaded spring retainer 550 in the body 510. This allows the maximum expanded diameter of the reamer to be set at the surface. The upper cap 555 is also a screwthreaded component and it is used to lock the spring retainer 550 once it has been positioned.

Figure 4:
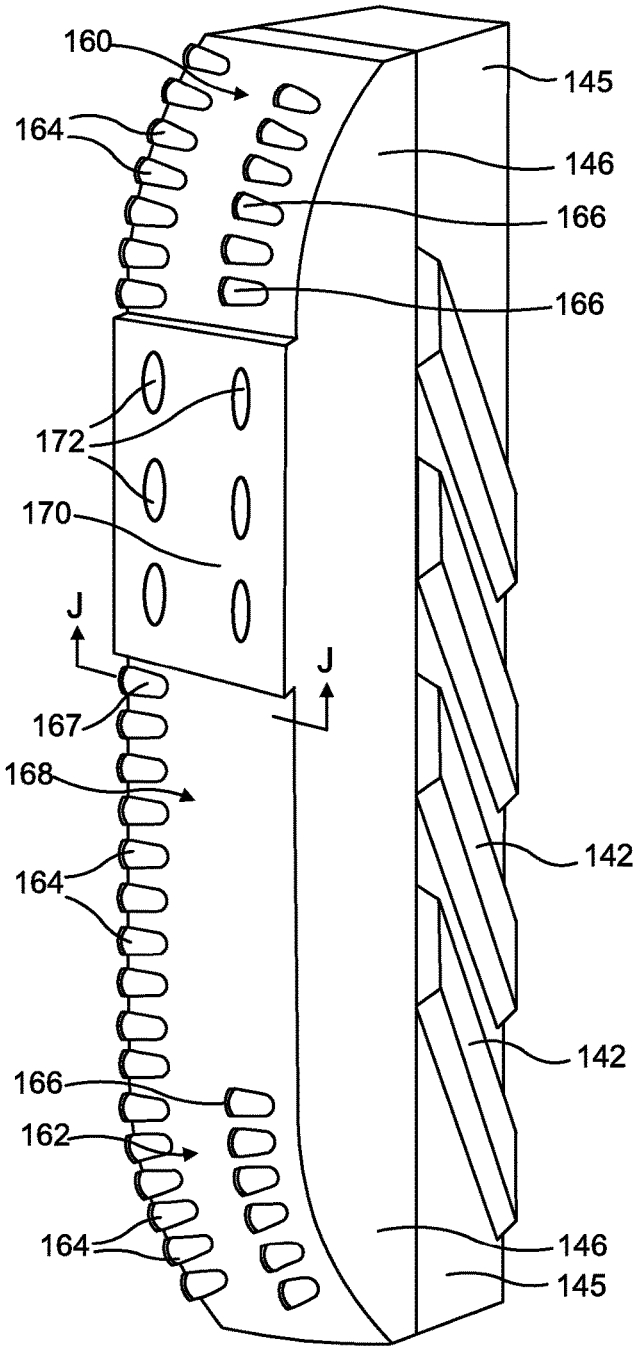
Fig 4 (prior art)
FIG. 4 is a perspective view of a cutter block for the expandable reamer of FIGS. 2 and 3.

FIG. 4 is a perspective view of a cutter block 140 showing the outer face of the block and the side face which is the trailing face in the direction of rotation. There is a conventional arrangement of cutters on the outer face. The block is formed of an inner part 145 and an outer part 146 bolted to the part 145 by bolts (not shown). The inner part 145 is steel and incorporates the protruding ribs 142. The outer part 146 of the block 140 is steel and has polycrystalline diamond (PDC) cutters secured to it.

Figure 6:
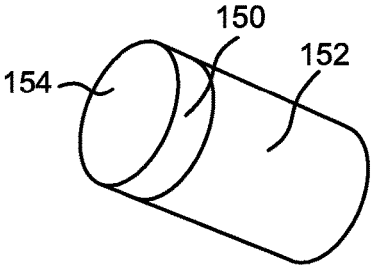
Fig 6 (prior art)
FIG. 6 is a detail view of a PDC cutter.

As shown in FIG. 6 such cutters have a sintered disc 150 of diamond crystals embedded in a binder material. This disc is at one end of a cylindrical body 152 which may be a sintered mass of tungsten carbide particles and a binder material. The bodies 152 of cutters are secured, for example by brazing, to the outer part 146 of the block 140 so that the hard faces 154 of the cutters are exposed. Although the cutter shown in FIG. 6 has a hard face 154 which is flat, other shapes including cones can be used.

The outer part 146 of the block 140 has upper and lower cutting portions 160, 162 on which PDC cutters are arranged in a leading row of cutters 164 and a following row of cutters 166. It will be appreciated that the upper and lower cutting portions 160, 162 are inclined (they are curved as shown) so that the cutters in these regions extend outwards from the tool axis by amounts which are least at the top and bottom ends of the block 140 and greatest adjacent the middle section 168 which includes stabilising pad 170.

When a reamer is advanced downwardly within a hole to enlarge the hole, it is the curved lower cutting portions 162 which do the work of cutting through formation rock. This takes place in FIGS. 1 and 5 as the drill string is advanced. The enlarged portion of the borehole can also be extended upwardly using the cutting portions 160 on the blocks 140 to remove formation rock while pulling upwardly on the drill string 112.

The stabilising pad 170 does not include cutters but has a generally smooth, part-cylindrical outward surface positioned to face and slide over the borehole wall. To increase resistance to wear, the stabilising pad 170 may have pieces 172 of harder material embedded in it and lying flush with the outward facing surface.

Figure 7:
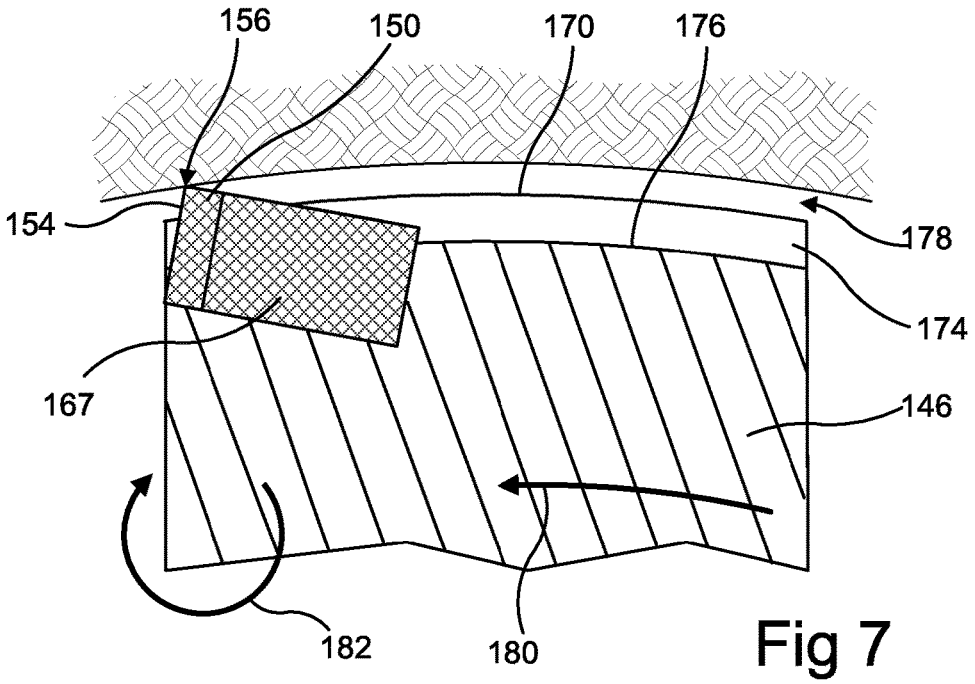
FIG. 7 is a cross section on line J-J of FIG. 4.

FIG. 7 is a section on line J-J of FIG. 4 showing one PDC cutter 167 mounted to the outer part 146 of the block 142. The cutter 167 is partially embedded in the outer part 146 and is oriented so that the hard face 154 will be facing forwards when the reamer is rotated. The direction of rotation is indicated by arrow 180. This hard face extends outwards to an extremity 156 which is at the maximum radius swept by the rotating reamer (i.e. its full gauge). The extremities of the other PDC cutters secured to the middle region 168 are also at the maximum radius swept by the rotating reamer. The outer surface of the stabilising pad 170 is positioned slightly radially inward from the extremities 156 of the cutters. The axially facing surface of the stabilising pad is indicated at 174 and the outer surface of the support structure in which the cutters are embedded is indicated at 176. This arrangement in which cutter extremities are at full gauge and pads 170 are slightly under gauge is conventionally used with an aim that the cutters protrude slightly and are able to cut as the reamer is being expanded, so that stabilising pads 170 do not impede expansion of the reamer.

Without limitation as to theory, the inventors believe that the extremity 156 of a cutter can become a pivot point, for instance if the extremity 156 snags briefly on the rock wall of the borehole as the reamer is rotated, rather than cutting steadily through the rock. The reamer may attempt to turn bodily around this pivot point in the direction indicated by arrow 182. The inventors believe this may initiate whirling motion even though other cutter blocks of the reamer may oppose or limit such pivoting.

Figure 8:
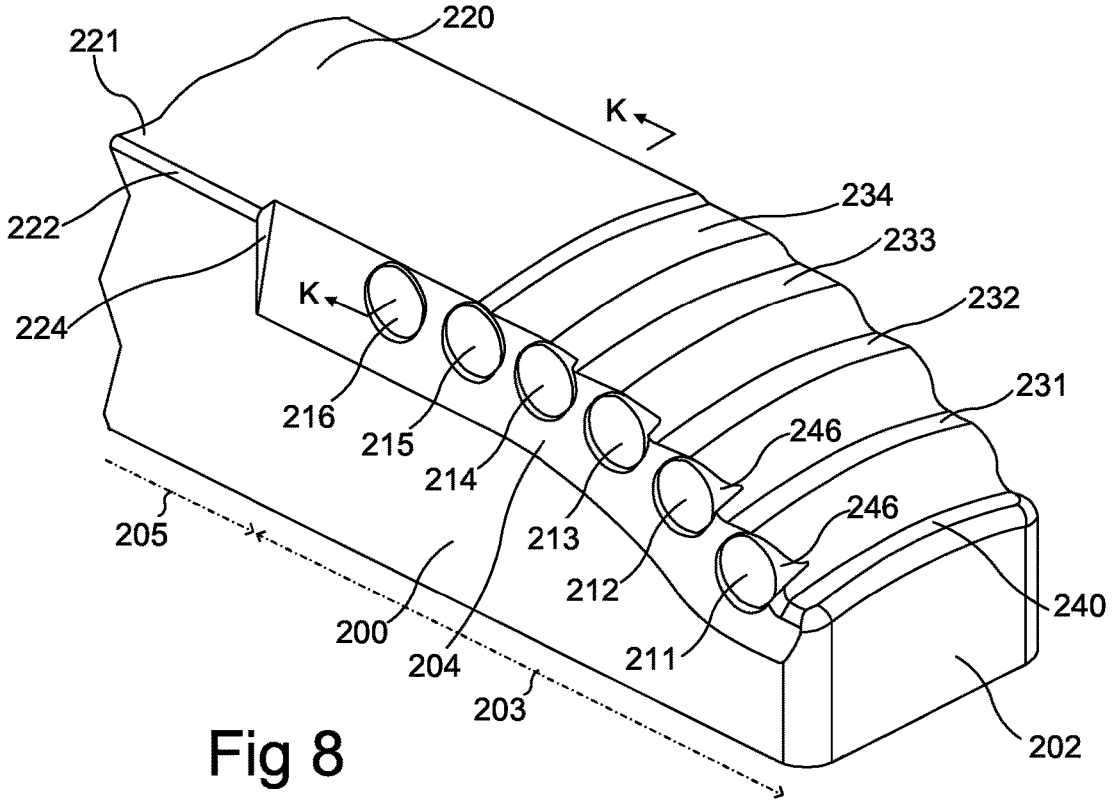
FIG. 8 is an isometric drawing of the lower cutting portion of the outer part of a cutter block, shown with the axial direction of the tool horizontal.

The reamer as described above, referring to FIGS. 1 to 7, is of a conventional construction. FIG. 8 onwards show parts of expandable reamers which utilise much of this conventional construction but have cutter arrangements and cutter blocks in accordance with the novel concepts disclosed here. Specifically, the reamers of FIG. 8 onwards utilise the expandable construction shown in FIGS. 2 and 3 and have cutter blocks with inner and outer parts as in FIG. 4. However, the construction of the outer parts of the cutter blocks and the arrangement of the cutters on the blocks is different from that shown in FIG. 4 and is in accordance with novel aspects of the present disclosure.

Figure 9:
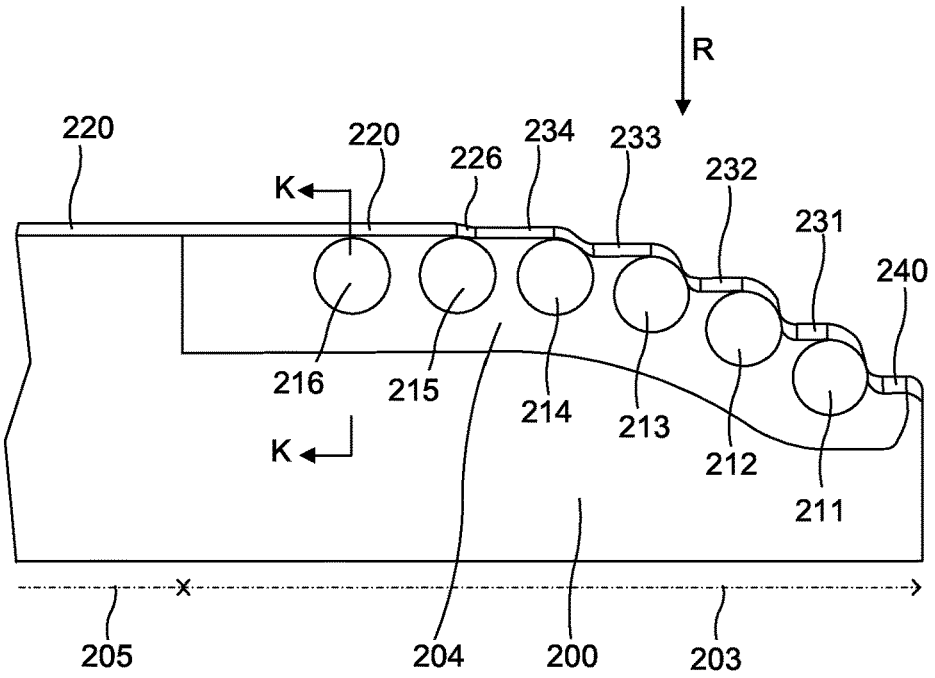
FIG. 9 is a side view of the lower cutting portion shown in FIG. 8, also with the axial direction of the tool horizontal.
Figure 10:
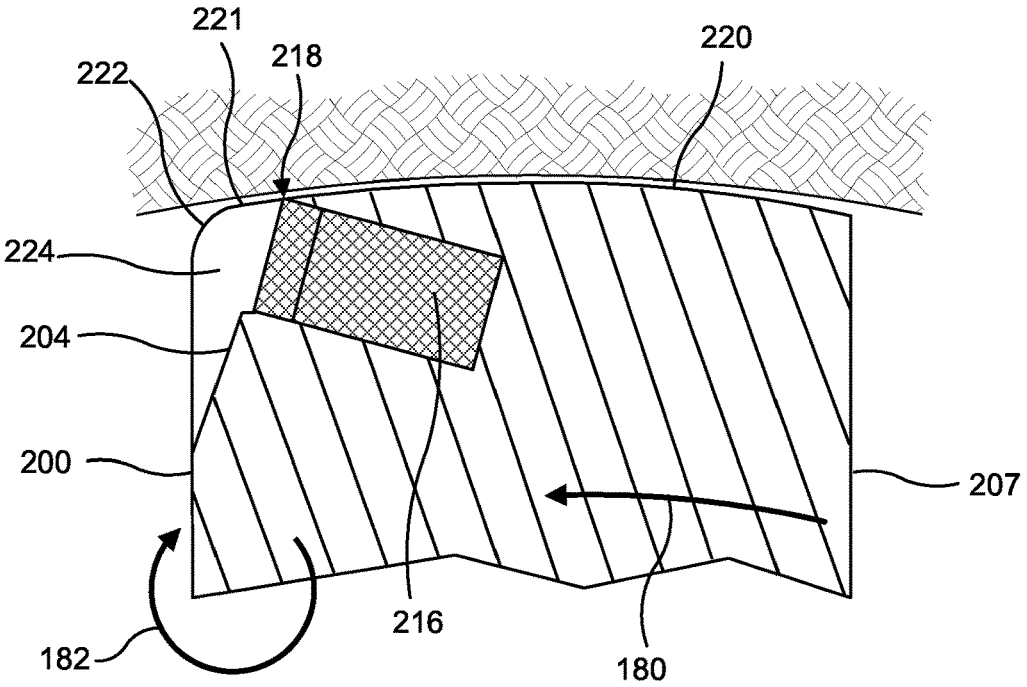
FIG. 10 is a cross section on the line K-K of FIGS. 8 and 9.

As with the conventional construction, the outer part of each cutter block is a support structure for PDC cutters. The support structure is formed of sintered tungsten carbide. FIGS. 8 to 10 show the lower cutting portion of the outer part of a cutter block. In these figures the tool axis is shown as horizontal. The block has a side face 200 which is the leading face in the direction of rotation and it has a lower axial end face 202. For part of its length indicated 203, the side of the block has an area 204 which is slanted back as shown by FIG. 10. The trailing face of the block is indicated 207 in FIG. 10.

A row of PDC cutters 211-216 is positioned with the hard surfaces of the cutters exposed within the slanted area 204 of the leading face of the block. The cutters are fitted into sockets in the steel supporting structure and secured by brazing so that they are embedded in the supporting structure. The cutters 211-215 are positioned at progressively increasing radial distances from the tool axis. The next cutter 216 is at the same radial distance from the tool axis as cutter 215. These cutters 211-216 are arranged in a single sequence with the cutters side by side and these are the only cutters on the lower portion of the cutter block. In contrast with FIG. 4, there is no second row of cutters behind.

This length 203 of the block with the slanted area 204 and cutters 211-216 adjoins a length 205 which does not include cutters and provides a stabilising pad with a part-cylindrical outward facing surface 220. The leading side surface 200 of the block extends outwards to meet the part-cylindrical surface 220 at an edge 222 with the consequence that there is a surface 224 facing axially at one end of the slanted area 204. As best seen in the cross-section which is FIG. 10, the edge 222 is a curved transition between the surfaces 200 and 220.

The outer surface 220 of the stabilising pad is at the full gauge of the reamer and so when the cutter blocks are fully expanded, the outer surface 220 is part of a cylinder which is centred on the tool axis and lies on the notional surface swept out by the rotating tool. The outer extremities of the cutters 215 and 216 are also at the full gauge of the reamer and also lie on this notional surface. This notional surface is akin to a surface of revolution, because it is the surface swept out by a rotating body, but of course the reamer may be advancing axially as it rotates.

The outer surface 220 extends axially over the cutter 216 and over half of cutter 215. Thus, as shown by the cross-section in FIG. 11, the cutter 216 (and also cutter 215) has its extremity 218 aligned with outwardly facing surface area which is behind the leading faces of these cutters 215, 216 and follows these leading faces as the reamer rotates.

The block thus has a surface 220 which faces outwardly at full gauge, which is larger than the surface area within the length 205 of the stabilising pad, and is available to stabilise the position of the tool within the borehole. Moreover, because this surface 220 lies close to or slides on the borehole wall, the extent of any pivoting around the cutter extremities is reduced.

A further enhancement of stability is that the edge 222 is ahead (in the direction of rotation) of the cutters 215 and 216 and as already mentioned it is formed as a smooth curve. This shape assists in inhibiting any part of the block, more specifically the extremities of cutters, from snagging on the formation during rotation, which promotes stable positioning of the reamer in the borehole.

The cutters 211-214 are embedded in the outer part of the block in a similar manner to the cutters 215, 216. The outer face of the block includes part-cylindrical surfaces 231-234 which extend behind the leading faces of cutters 211-214 respectively and which are aligned radially with the extremities of the respective cutters. These surfaces 231-234 act as secondary gauge areas: the surface 231 slides over rock which has just been cut by the action of cutter 211, surface 232 slides over rock cut by cutter 232 and so on. Of course, the rock surfaces created by cutters 211-214 have only a transient existence. They are cut away by cutters at a greater radius as the reamer advances. Nevertheless, this provision of secondary gauge areas contributes to stabilisation of the position of the rotating reamer.

Figure 11:
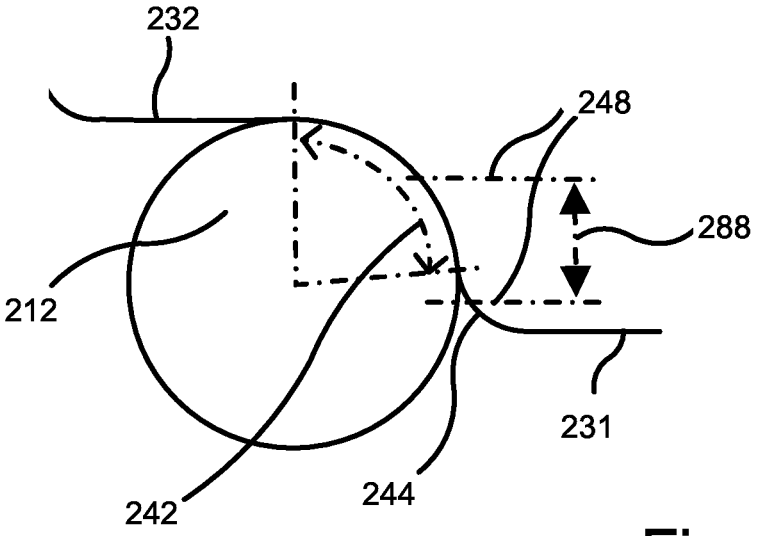
FIG. 11 is a diagrammatic enlarged view showing one cutter of FIG. 9.

The outer face of the block includes portions connecting the part cylindrical surfaces 231-234. Referring to FIG. 11, from the surface 232 towards surface 231 the outer face of the block curves through an arc (indicated by angle 242) where it is aligned with the perimeter of cutter 232. It then curves in the opposite sense, as seen at 244, to join the part cylindrical surface 231. There is a similar arrangement between surfaces 234 and 233, between 233 and 232 and also between surface 231 and a part cylindrical surface 240 located between cutter 211 and the axial end of the block. This geometry allows small areas of the cylindrical surfaces of the cutters to remain visible as for example indicated at 246. The surface 220 is connected to surface 234 by a small tapered face 226.

Figure 13:
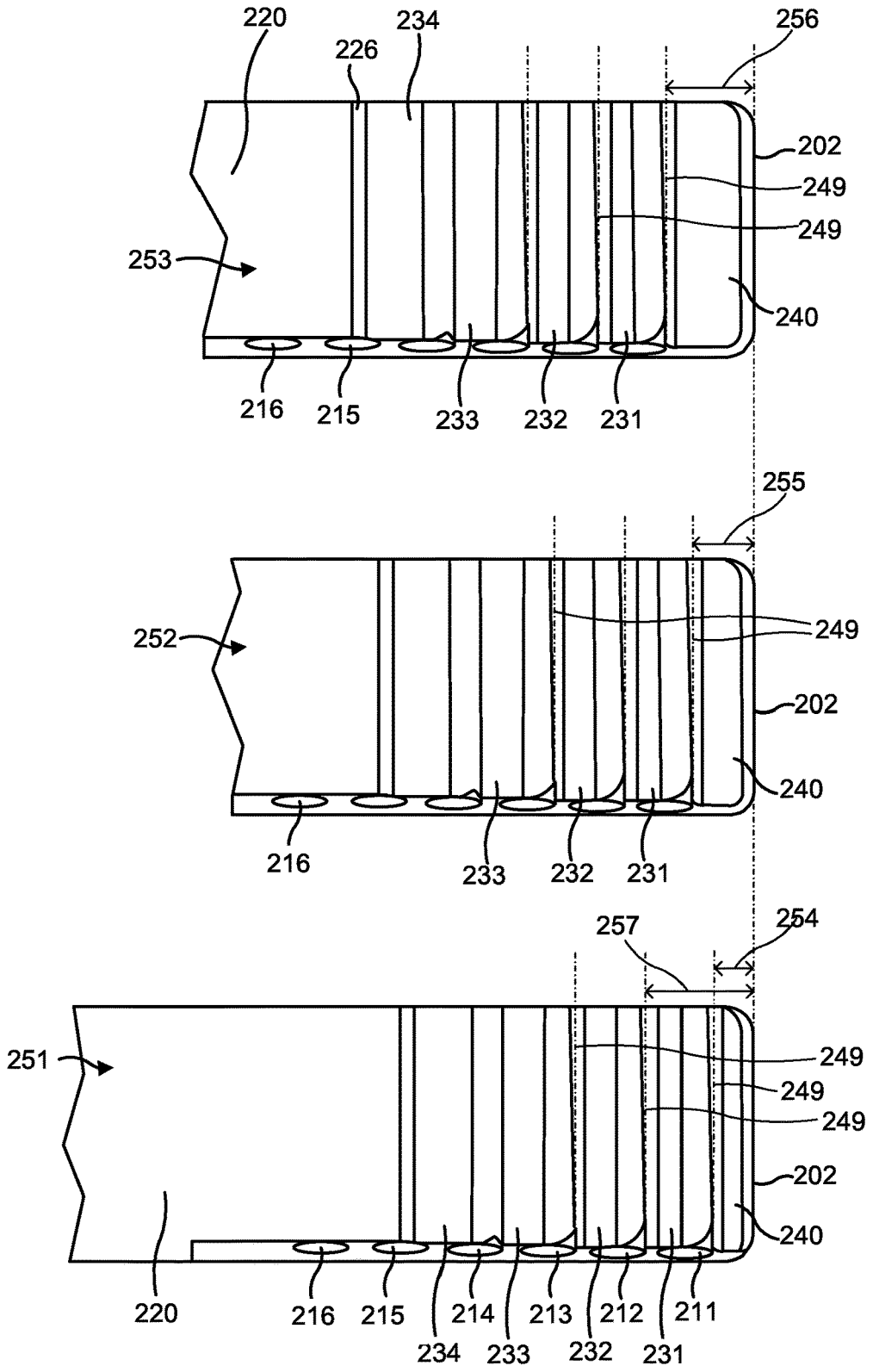
FIG. 13 is a radial view onto the lower cutting portions of three cutter blocks.

FIG. 13 shows the lower cutting portions of the three cutter blocks of the reamer. The ends 202 of the blocks are aligned axially as indicated by a chain-dotted line. The block shown in FIGS. 8 to 11 is block 251 at the bottom of the diagram. The lower cutting portions of the other two blocks are indicated at 252 and 253. These follow block 251 as the reamer is rotated and of course block 251 follows block 253. The configuration of cutters 211-214 and the supporting structure around them, as described above with reference to FIGS. 8 to 11 for block 251, is reproduced on blocks 252 and 253. Thus the axial and radial positions of cutters 211-214 and the surrounding support structure including surfaces 231-234 are the same relative to each other on all three cutter blocks, but the axial distances between these functional parts and the ends of the blocks and the radial distances from these functional parts to the tool axis differs from one block to another. Since the blocks are aligned and move in unison, the axial distances between functional parts and the end of the tool, or any other reference point on the tool, differ from one block to another in the same way as the distances between these functional parts and the ends 202 of the blocks.

As indicated by the arrows 254, 255, 256 the axial distances from the end of each block to the edge of cutter 211, and likewise the distances to the other cutters, increase in the order: block 251, block 252, block 253. However, the distance indicated by arrow 256 to the edge of cutter 211 of block 253 is not as great as the distance 257 to the edge of cutter 212 of block 251. The cutters 211-214 of the block 252 are positioned radially slightly further from the axis of the tool than the corresponding cutters of block 251. Similarly the cutters 211-214 of block 253 are positioned slightly further from the axis of the tool than the corresponding cutters 211-214 of block 252. Axial distances from the ends of the blocks to the cutters 215 also increase in the order block 251, block 252, block 253, but the cutters 215 are at full gauge and so are at the same radial distance from the tool axis.

The axial distances are such that corresponding points on the three cutter blocks, for instance the radial extremities of the cutters 211 on the three blocks, lie on an imaginary helix around the tool axis. Moreover, in this embodiment the axial and radial distances and the spacing between cutters of the sequence on each block is such that the outer extremities of all the cutters 212-214 also lie on a continuation of the same helix, as is illustrated diagrammatically by FIGS. 14 and 15.

Figure 14:
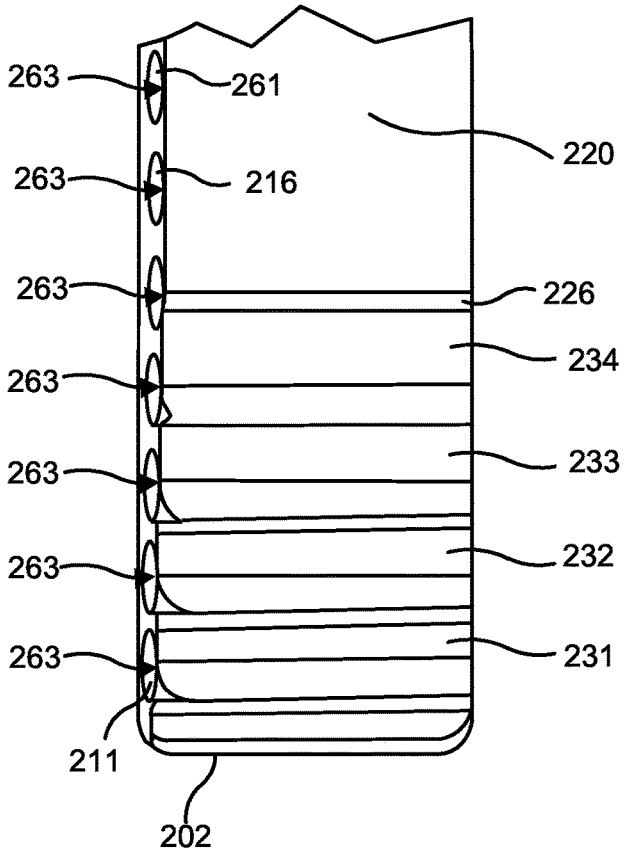
FIG. 14 is a radial view onto the lower cutting portion of a cutter block, similar to that in FIG. 12 but with the axis of the tool vertical.
Figure 15:
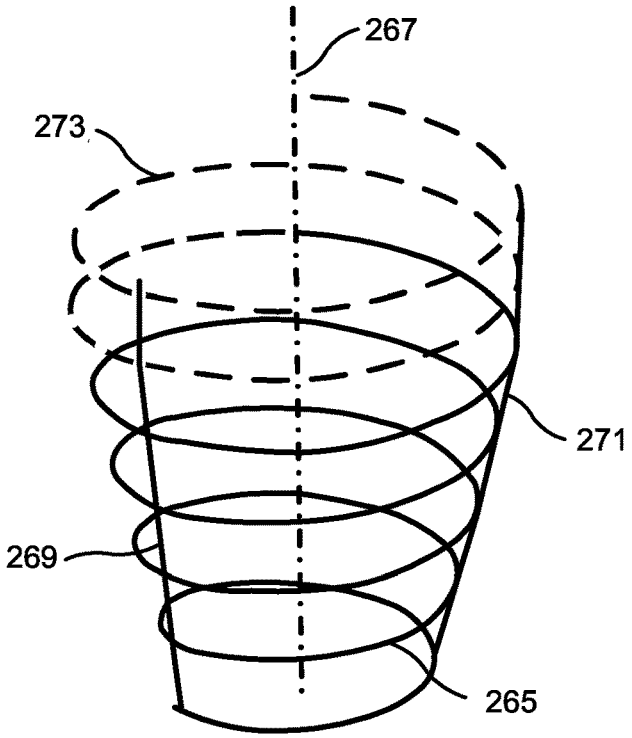
FIG. 15 diagrammatically illustrates positioning on a helix.

FIG. 14 shows the lower portion of a cutter block which is almost identical to the block 251, although with an additional cutter 261 at full gauge alongside cutter 216. In this figure the tool axis is vertical. The radially outer extremities of the cutters are indicated by the heads of arrows 263. FIG. 15 shows the path of a helix as a solid line 265. This helix has progressively increasing diameter as it winds upwards around axis 267. The block 251 is positioned so that (when expanded) the radial extremities of its cutters 211-214 lie on the helix 265 at its intersections with vertical line 269. The block 252 is positioned so that the radial extremities of its cutters 211-214 are on the helix 265 at its intersections with vertical line 271, which is 120° around the axis from line 269. The block 253 is positioned so that the radial extremities of its cutters 211-214 also lie on the helix 265 at its intersections with a further vertical line (not shown) which is 120° around the axis from line 271 and so would be at the back of the helix as depicted in FIG. 15. The cutters 215, 216 at full gauge lie on a continuation of this helix at constant diameter, which is indicated in FIG. 15 as dashed helix 273. Further cutters such as 261 at full gauge may also lie on the helix 273.

Thus, as distances of the cutters 211-214 from the ends of the blocks increase, the radial distances from the tool axis increase also. This arrangement enables all cutters of the lower cutting portions of the blocks to cut into the rock as the tool rotates. As the reamer advances axially, the first cutter able to contact rock is the lowest cutter, which is cutter 211 of block 251. Because of the helical arrangement, this is followed by cutter 211 of block 252 at slightly greater distance from the tool axis, then by cutter 211 of block 253 and then by cutter 212 of block 251, cutter 212 of block 252 and so on.

Referring again to FIG. 11, it can be seen that the portions of the outer face of the block between surfaces 231-234 have zones, such as indicated at 288 between the chain lines 248, which face in a generally axial direction and so face towards formation rock which is to be cut away as the reamer advances axially. Facing in a generally axial direction may be taken to mean that a line normal (i.e. perpendicular) to the surface is at an angle of no more than 45° to the tool axis. In order that contact between these zones and the rock does not prevent axial advance of the reamer, these zones are configured so that their circumferential extent does not run exactly orthogonal to the reamer axis.

Figure 12:
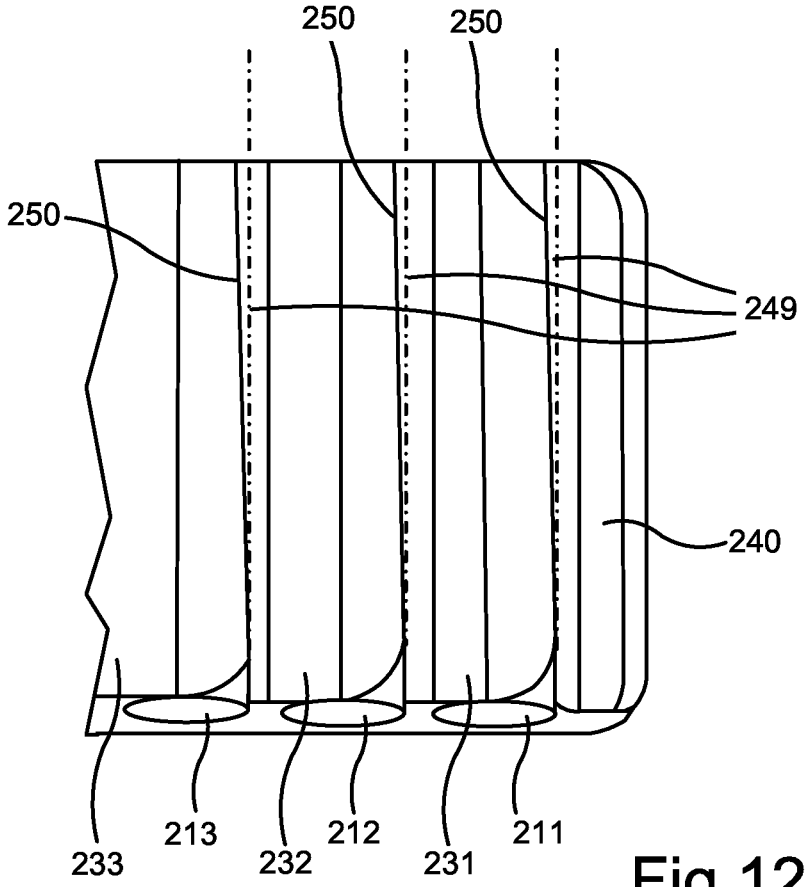
FIG. 12 is an enlarged radial view onto the end portion of a cutter block in the direction of arrow R in FIG. 9.

This is shown by FIG. 12 which is an enlarged view, looking radially inwards as indicated by arrow R in FIG. 9, onto the cutter block 251 of FIGS. 8 to 11. Directions orthogonal to the axis of the reamer are shown by notional lines 249. The lines 250 aligned with edges of cutters 211-213 in FIG. 12 are the inflection where curvature through arc 242 changes to curvature through arc 244. The portions of outer surface which face generally axially are shaped to taper away from the end of the cutter block (and also the end of the reamer) as they extend circumferentially around the tool axis, in the backward direction from the leading faces of the cutters. Thus the lines 250 are at an angle to the orthogonal direction indicated by the lines 249.

The angles between lines 250 and 249 are arranged so that the axially facing zones of the blocks' outer faces lie approximately on a helix around the reamer axis which is similar to the helix 265. As the reamer rotates, the axially facing zones contact the newly cut rock but because they are positioned on a helix, rather than being orthogonal to the axis, they do not prevent axial advance of the reamer even though they do impose some control of the rate of advance.

The inventors have found that the controlled rate of advance can be approximately the same as the rate of uncontrolled advance achieved with a conventional reamer construction. For example a reamer with an expanded diameter of 150 mm may have angle of slightly less than 1 degree between the lines 250 and 249 and advance by 6 mm in each revolution. The axial spacing between the cutters may then be approximately equal to this distance of 6 mm. A reamer may have a diameter larger than 150 mm, for instance up to 600 mm or even more with the same designed rate of advance of 6 mm.

Figure 16:
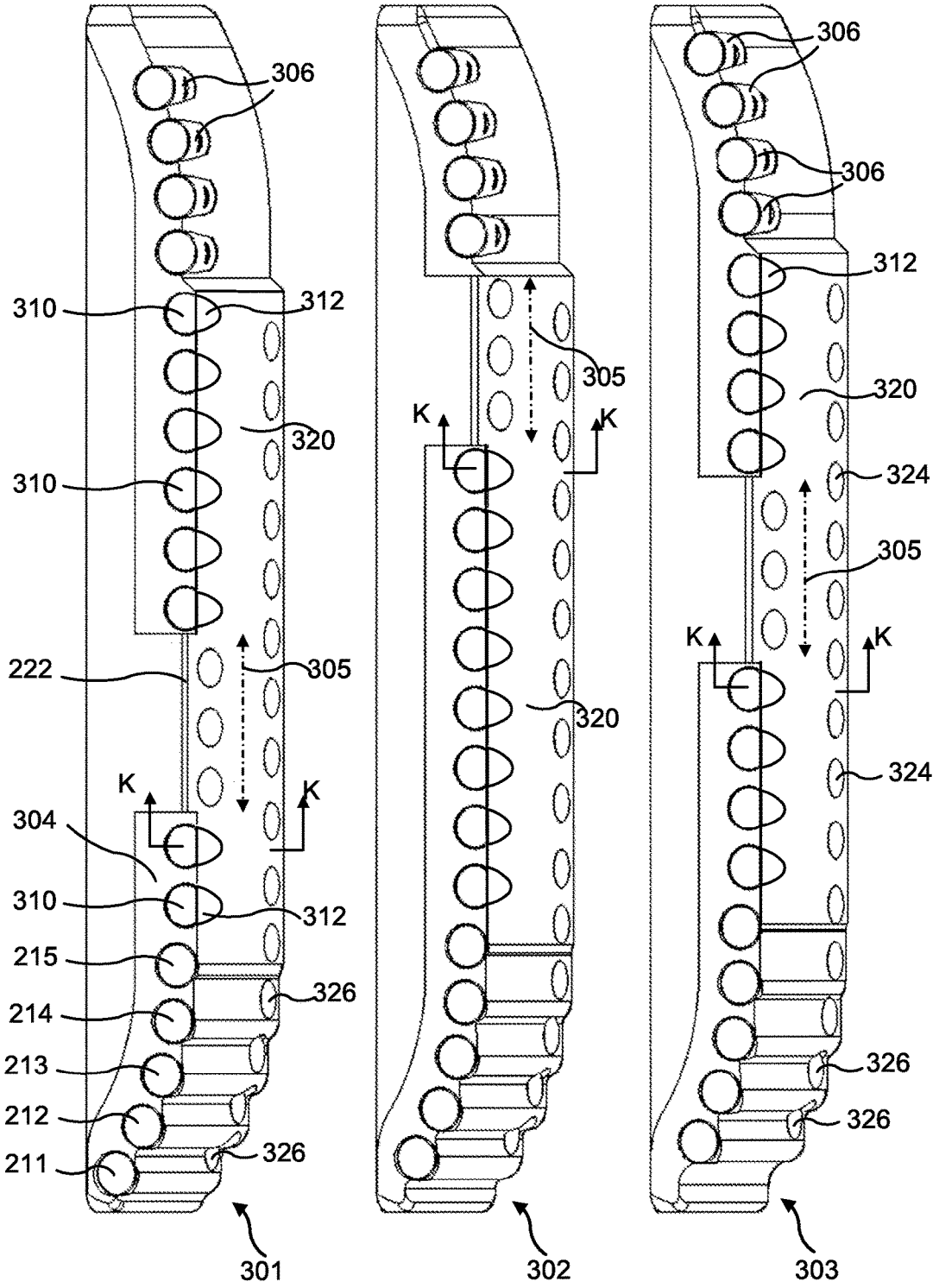
FIG. 16 shows the outer parts of three cutter blocks in three-quarter view.
Figure 17:
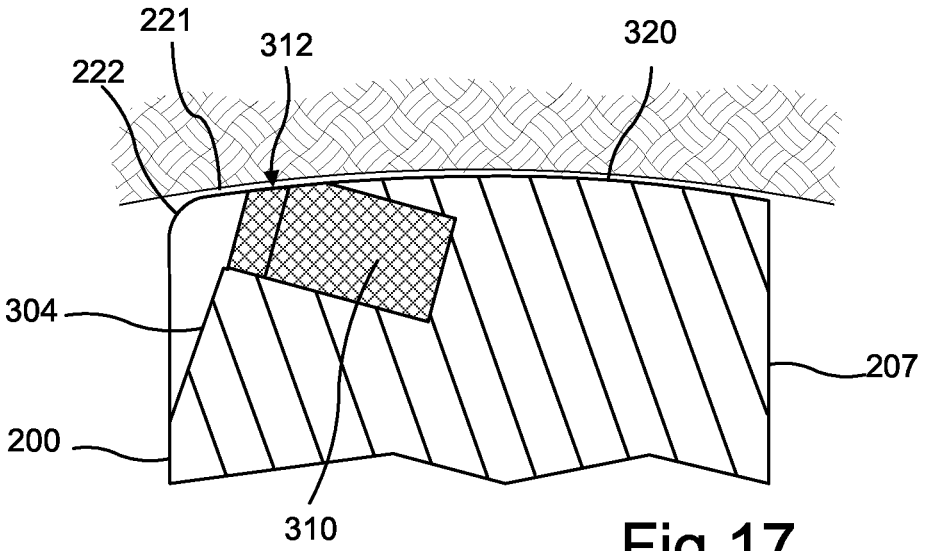
FIG. 17 is a section on line K-K of any of the three cutter blocks of FIG. 16.

FIG. 16 shows the whole of the outer parts of the three cutter blocks of another reamer. These use a number of features already shown by FIGS. 8-13 and the same reference numerals are used where appropriate. There are also some differences. As before the general structure of the reamer and the mechanism which expands it are as shown by FIGS. 2, 3 and 4. FIG. 17 shows a section, which could be on any of the lines K-K of FIG. 16.

The blocks 301, 302, 303 have cutters 211-215 at their lower cutting portions as in FIGS. 8 to 13. At the upper cutting portion, which is used to enlarge a borehole when pulling up on a drill string, there are a group of cutters 306 mounted conventionally, similarly to those in upper cutting portion 160 of FIG. 4.

A middle section between these two ends has an outer surface 320 which is a part-cylindrical surface at full gauge. Within this middle section, each block includes a length 305 without cutters which is a full gauge stabilising pad. As in FIG. 8, within the lengths 305 which are the stabilising pads, the outer surface 320 has a leading region 221 which extends to a leading edge 222 which is ahead, in the direction of rotation, of the leading surfaces of the cutters and is curved as shown in FIG. 15.

As disclosed in copending GB patent application GB2520998A, these lengths 305 which provide stabilising pads are at different axial positions on the blocks in order to provide stabilisation without preventing expansion of the reamer. As the reamer is expanded, each stabilising pad presses on the borehole wall. The pads cannot cut into the wall but the other two cutter blocks have cutters at the corresponding axial position and these do cut into the wall. This arrangement avoids placing three stabilising pads at the same axial position on the reamer, which does prevent expansion.

The remainder of each middle section of each block is provided with a row of cutters which are embedded so that their faces are exposed in a slanted area 304 and their radial extremities are aligned with the outer surface 320. However, these cutters are made with a truncated cylindrical shape and are secured to the support structure such that, as seen in FIG. 15, their extremities are an area 312 which is flush with surface 320. It will be appreciated that the cutters on each block form a single sequence of cutters distributed axially along the block with each cutter alongside another.

As can be seen from the drawing, the cutters in the lower cutting portions of blocks 302, 303 are positioned axially further from the end of the block than the corresponding cutters on block 301.

Near the trailing edge of surface 320, each block has a row of hard inserts 324 which are set flush with the surface 320 and are harder than the surface 320 of the steel outer part of the block, so as to resist wear. These hard inserts may be made of tungsten carbide particles sintered with a binder. There are also hard inserts 326 embedded to be flush with surfaces 231-234.

Figure 18:
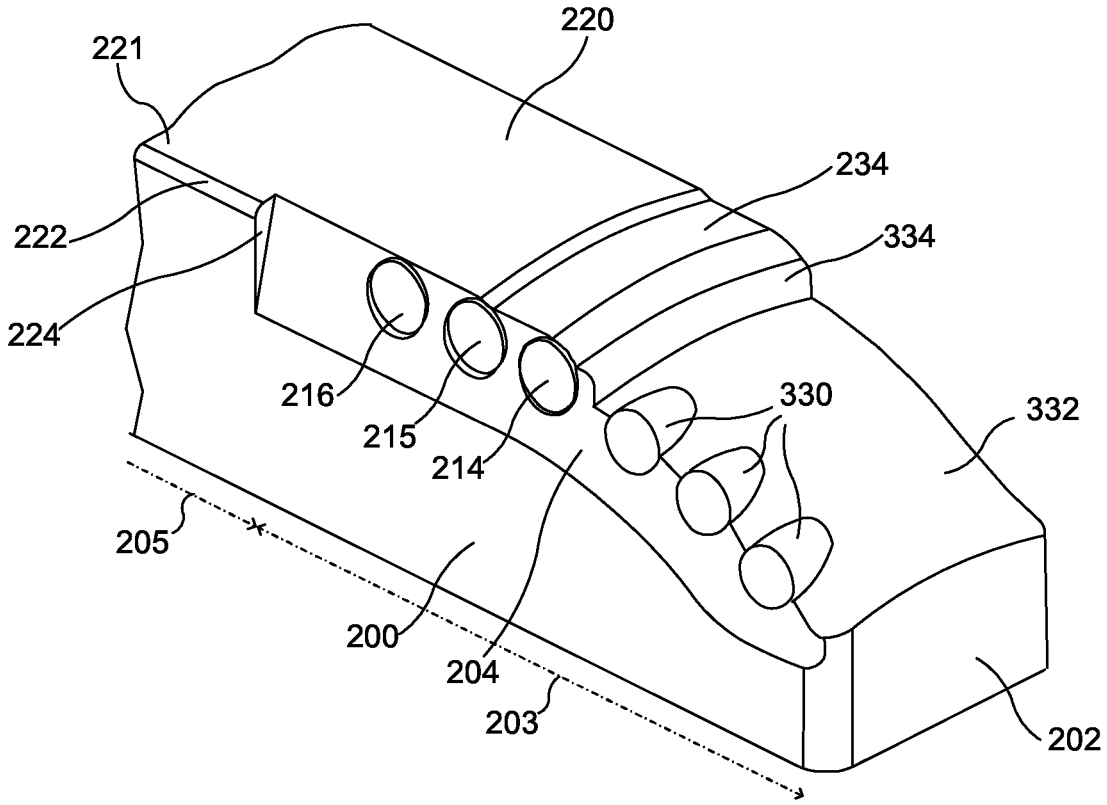
FIG. 18 is an isometric drawing showing a modification to the block of FIG. 8.

FIG. 18 shows a possible variation on the arrangement of FIG. 8. The block has leading face 200, slanted area 204, stabilising pad in the length 205, and embedded cutters 214, 215 and 216 all as in FIG. 8. However in place of the cutters 211-213 there are three cutters 330 which are embedded in conventional manner so as to project outwardly beyond the surface 332 of the support structure around them.

To allow axial advance of a reamer with these cutter blocks, the zone 334 which faces generally axially is oriented to taper back from a direction orthogonal to the axis in a manner similar to that described with reference to FIGS. 12 and 13. Such a reamer may have three cutter blocks in which the cutters 214, 215 and 216 are at differing distances from the end of the block, as in FIG. 13, while the cutters 330 next to the lower ends of the three blocks may possibly be at the same distances from the axial end of the blocks or at different distances from the ends of the blocks.

Figure 19:
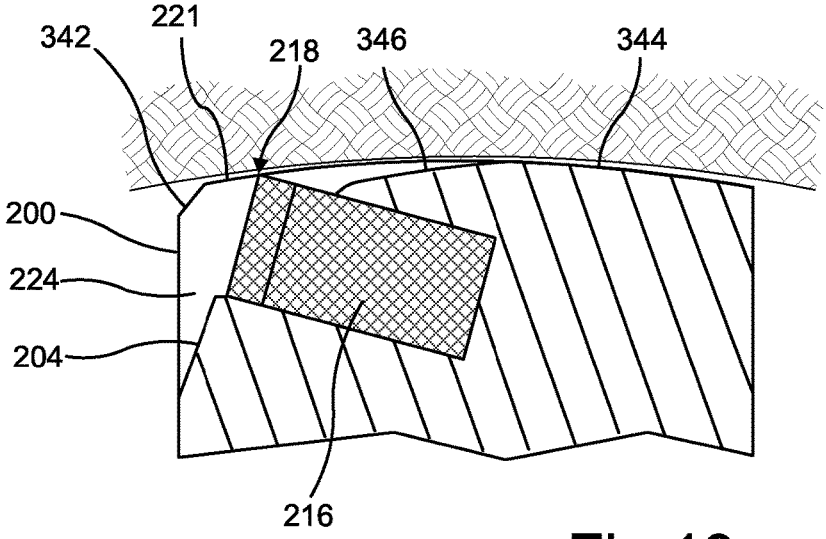
FIG. 19 is a cross section similar to FIG. 10 but showing other modifications.

FIG. 19 is a cross-section analogous to FIG. 10 and used to illustrate two further variations from the arrangement of FIGS. 8-10. The curved edge 222 is replaced with a flat surface 342 at about 45° to the leading surface 200 of the block. Separately, the support structure in which the cutter 216 is embedded has a surface area 344 which is at full gauge in the trailing half of the block, and a surface area 346 which slopes outwardly between the cutter and the mid point of the block's width. Extremity 218 of the cutter 216 is at full gauge. Consequently the extremity 218 is aligned with a surface area 344 which follows behind it but it is spaced from this area.

Figure 20:
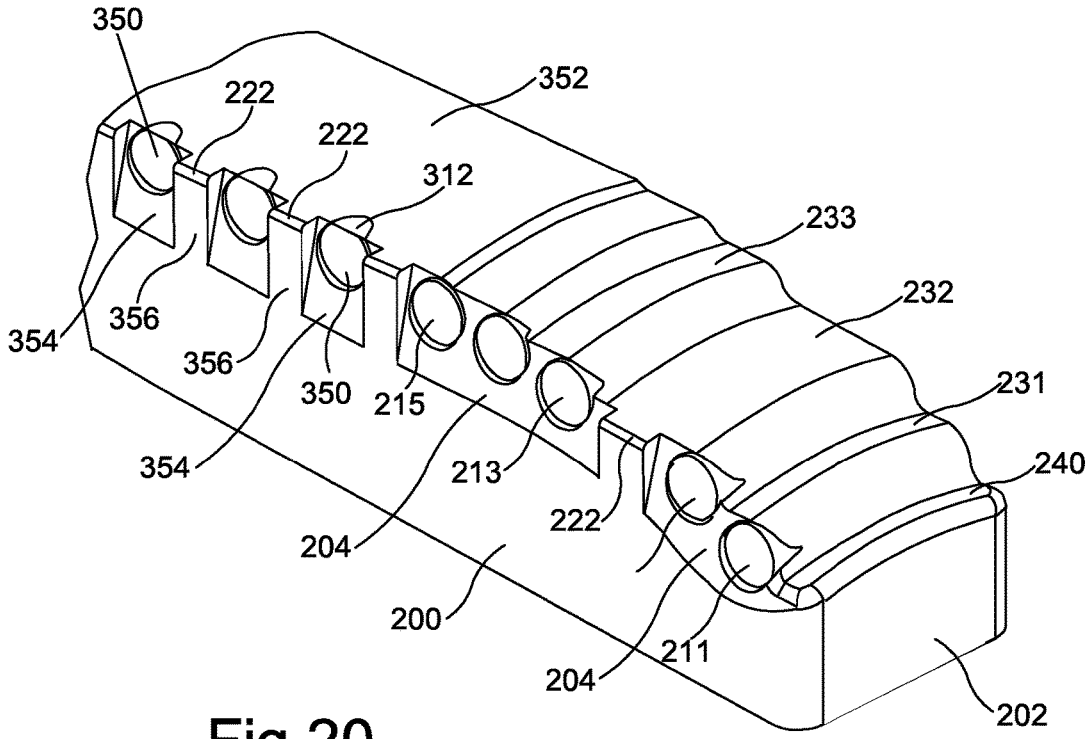
FIGS. 20 and 21 are isometric drawings showing further modifications to the block of FIG. 8.

FIG. 20 shows another possible variation. The lower cutting portion of a cutter block has a number of features similar to those in FIG. 8. However, the axial distance between cutters 212 and 213 is increased, compared to FIG. 8, so that the secondary gauge surface 232 has a larger axial extent. Of course this increases the overall axial length of the tool. This surface 232 extends forwardly of cutters 212 and 213 and joins an outward continuation of the planar leading surface 200 through a curved edge 222. The cutters 350 at full gauge are truncated cylinders positioned similarly to cutters 310 seen in FIG. 16, so that their radial extremities are faces 312. These are each exposed at slanting surfaces 354, but between each of these cutters the gauge surface 352 extends forwardly and joins outward continuations 356 of the plane surface 200 at edges 222.

Figure 21:
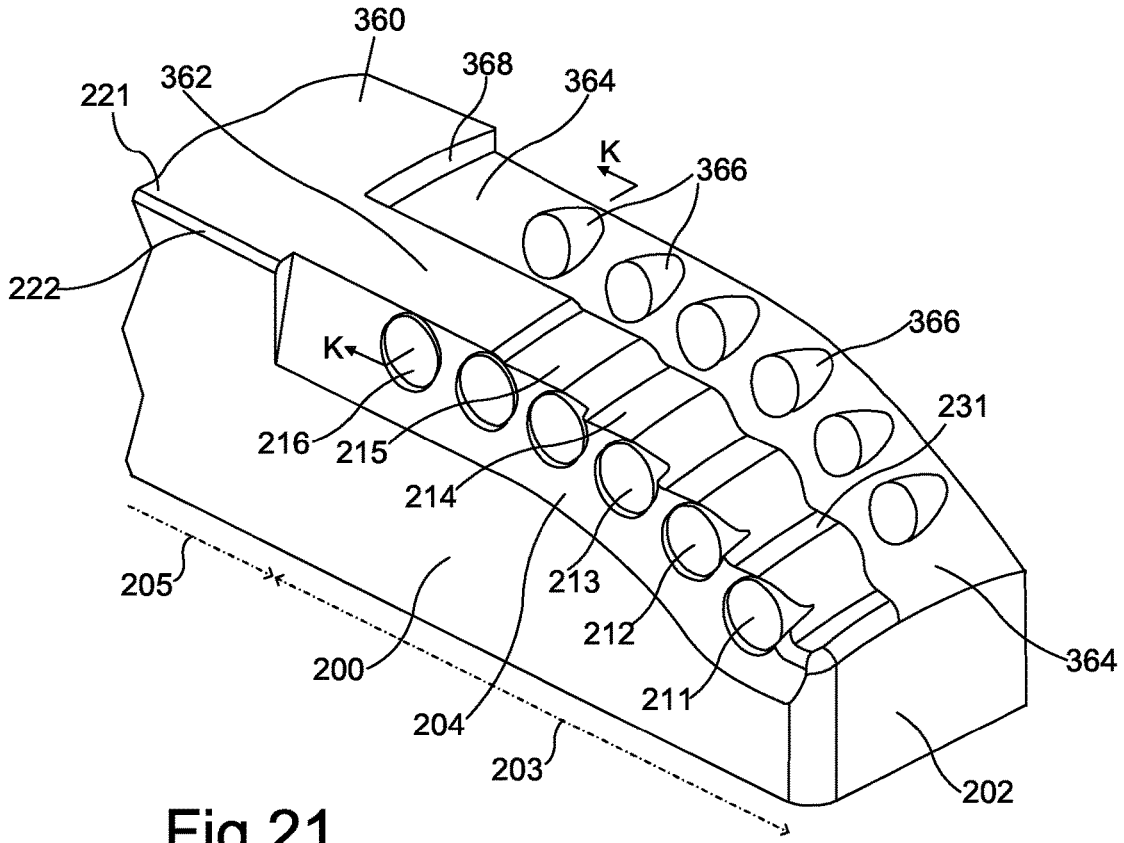
Figure 22:
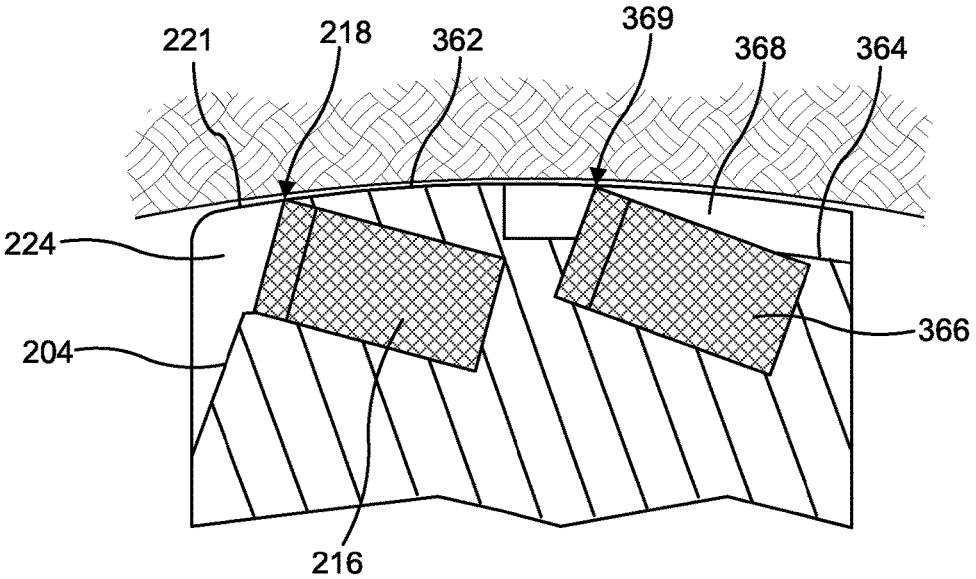
FIG. 22 is a section on line K-K of FIG. 21.

FIGS. 21 and 22 show a further form of cutter block which is another variation on FIG. 8. The leading surface 200 with slanted surface 204 and embedded cutters 211-216 are the same as in FIG. 8. The extremities of the cutters 215 and 216 are aligned with surface 320 at full gauge and the cutters 211-214 are aligned with surfaces 231-234. The surface 360 has a leading region 221 which joins the side face 200 of the cutter block at a curved leading edge 222. This is all as shown in FIGS. 8 to 13 except that the surfaces 231-234 extend across only the leading half of the cutter block and also a part 362 of the full gauge surface 360 which continues axially from the stabilising pad over cutters 216 and 215 extends across only the leading half of the cutter block.

The trailing half of the cutter block, behind the cutters 211-214, has a structure similar to that shown in FIG. 4 with a row of cutters 366 partially embedded in support structure, like the row 166 and projecting beyond the surface 364 of this part of the support structure so that their radial extremities 369 are at full gauge. A face of the stabilising pad is indicated at 368.

Modifications to the embodiments illustrated and described above are possible, and features shown in the drawings may be used separately or in any combination. The arrangements of stabilising pads and cutters and/or the feature of gauge surfaces projecting forwardly of cutter extremities, could also be used in a reamer which does not expand and instead has cutter blocks at a fixed distance from the reamer axis. Other mechanisms for expanding a reamer are known and may be used. Cutters may be embedded or partially embedded in supporting structure. They may be secured by brazing or in other ways. The hard faces of the cutters will of course need to be exposed so that they can cut rock, but the radially inner part of a cylindrical cutters' hard face may possibly be covered or hidden by a part of the support structure so that the hard face is only partially exposed.

Experimental Test

A comparative test was carried out using two reamers to enlarge holes previously drilled through rock test pieces. One reamer had cutter blocks as shown in FIGS. 8 to 11. The other (comparative) reamer had cutter blocks with lower cutting portions having cutters 211-216 and surfaces 231-234 as in FIGS. 8 to 11, but did not have the forwardly extending region 221. In place of this region the slanted area was continued along the full length of the cutter block. For the purpose of carrying out this comparative test the reamers were of fixed diameter and were not constructed to be expandable.

Figure 23:
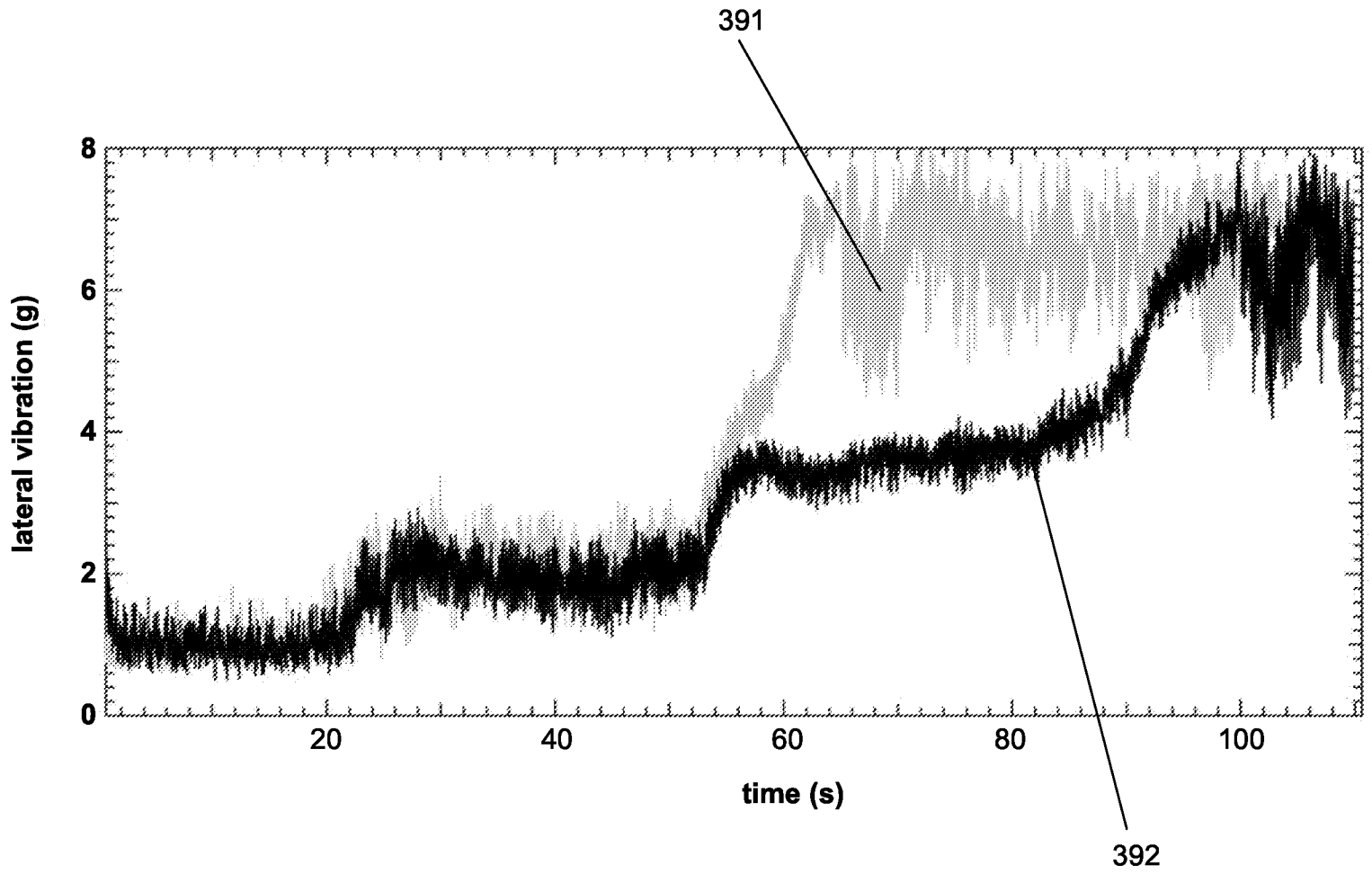
FIG. 23 is a plot of vibration measured during a comparative test.

The magnitude of vibration with each reamer was measured using accelerometers. Results are shown in FIG. 23. The results without the forwardly extending region are shown as the grey trace 391. The results with the forwardly extending region 221 are shown as the superimposed black trace 392. As can be seen, vibration remained at a low level for a longer time when the forwardly extending region 221 was present.

Analysis of the frequencies within the vibration showed that without the forwardly extending region 221 there was a vibration frequency attributed to impact of the cutter extremities on the borehole wall. This frequency was absent from vibrations with region 221 present, indicative that whirling with these regions present was a rolling action on the wall rather than a more destructive impact against the wall.

A second comparative test was carried out. Again one reamer had catter blocks as shown in FIGS. 8 to 11. The comparative reamer had conventional construction with the cutters projecting radially outwardly from the support structure as illustrated in FIG. 4. In this second test the reamers were again of fixed diameter and were not constructed to be expandable.

The magnitude of vibration with each reamer was again monitored using accelerometers and the rate of penetration (i.e. speed of axial advance) was measured. The reamer with conventional cutter blocks displayed significant vibration. By contrast when the reamer with blocks as in FIGS. 8 to 11 was driven at the same speed of rotation, with the same weight on the tool (weight applied to push the reamer forward) there was negligible vibration and the rate of penetration was 2.5 times the rate of penetration achieved with conventional cutter blocks.

The dramatic reduction in vibration was immediately apparent in the vicinity of the test rig. With conventional cutter blocks there was so much vibration of the building in the vicinity of the test rig that objects were shaken off tables. With cutter blocks as in FIGS. 8 to 11, people near the test rig experienced no noticeable vibration.

The invention claimed is:

1. A reaming tool for enlarging an underground borehole, comprising:

a plurality of cutter assemblies distributed azimuthally around a longitudinal axis of the tool, and which are radially expandable relative to the longitudinal axis, wherein each cutter assembly comprises a supporting structure and a plurality of hard faced cutters secured therein with a hard face of each cutter facing in a direction of rotation of the tool, wherein each cutter assembly includes at least one outward-facing surface at a radial distance from the tool axis, with a gauge portion of the outward-facing surface radially aligned with the radially outer extremity of at least a radially outermost cutter of the plurality of hard faced cutters, and wherein the gauge portion extends in the direction of rotation circumferentially ahead of the extremity of the radially outermost cutter.

2. The reaming tool of claim 1 wherein the gauge portion also extends circumferentially behind the radially outermost cutter.

3. The reaming tool of claim 1 wherein the gauge portion projects circumferentially ahead of the radially outermost cutter to a leading edge at which the gauge portion is joined to a radially extending surface of the cutter assembly by a surface which is inclined to both the gauge portion and radially extending surface of the cutter assembly.

4. The reaming tool of claim 1 wherein the gauge portion projects circumferentially ahead of the radially outermost cutter to a leading edge at which the gauge portion is joined by an arcuate surface to a radially extending surface of the cutter assembly.

5. The reaming tool of claim 1 wherein the plurality of cutters comprises a row of cutters with radially outward extremities at equal distance from the tool axis and the gauge portion is aligned at the same radius from the tool axis as the radial extremities of the row of cutters and extends in the direction of rotation circumferentially both behind and ahead of the exposed faces of the cutters in the row.

6. The reaming tool of claim 5 wherein an axial end portion of the cutter assembly comprises further cutters which also have hard faces facing in a direction of rotation of the tool but which extend radially out to extremities at radial distances from the axis of the tool which are less than the radial distance to the extremities of the cutters in the row of cutters.

7. The reaming tool of claim 1 wherein an axial end portion of the supporting structure comprises a sequence of regions where each region has at least one cutter secured therein with a hard face of the cutter facing in a direction of rotation of the tool and each region has a secondary gauge portion of the outward-facing surface aligned with the outward extremity of the at least one cutter in the region, the radial distances from the axis to the outward-facing surfaces of the regions increase in a direction away from an end of the cutter assembly, and at least one secondary gauge portion extends in the direction of rotation circumferentially ahead of the face of the at least one cutter radially and axially aligned therewith.

8. The reaming tool of claim 1 wherein the supporting structure comprises a first length with the plurality of hard faced cutters secured therein and an adjoining second length without cutters, the second length providing a stabilising pad with the gauge portion of the outward-facing surface at a radial distance from the tool axis which aligns the gauge portion with the radially outer extremity of at least one cutter in the first length and the gauge portion extends in the direction of rotation circumferentially ahead of the hard faces of the cutters in the first length.

9. The reaming tool of claim 1 wherein the radially outermost cutter is axially offset from a length of the gauge portion that extends in the direction of rotation circumferentially ahead of the extremity of the radially outermost cutter.

10. The reaming tool of claim 1, wherein the gauge portion extends in the direction of rotation circumferentially ahead of the extremity of each of the plurality of hard faced cutters secured in the supporting structure.

11. The reaming tool of claim 1, wherein the radially outermost cutter is in a rotationally leading row of the plurality of hard faced cutters.

12. A reaming tool for enlarging an underground borehole, comprising:

a plurality of radially expandable cutter assemblies distributed azimuthally around a longitudinal axis of the tool with each cutter assembly comprising a supporting structure and a plurality of hard faced cutters embedded therein, wherein:

the supporting structure comprises a first length and an adjoining second length;

the first length has a sequence of hard faced cutters of the plurality of hard faced cutters embedded in the supporting structure with a hard face of each cutter of the sequence of cutters exposed and facing in a direction of rotation of the tool;

the second length of the support structure has an outward-facing gauge surface aligned at the same radial distance from the tool axis as the radially outer extremity of at least the nearest cutter; and the gauge surface extends in the direction of rotation circumferentially ahead of the radially outward extremities of the exposed faces of the sequence of cutters.

13. The reaming tool of claim 12 wherein the sequence of hard faced cutters in the first length comprises a row of cutters positioned with their extremities at equal radial distance from the tool axis and same radius and further cutters which extend radially out to extremities at radial distances from the axis of the tool which are less than the radial distance to the extremities of the cutters in the row of cutters.

14. The reaming tool of claim 12 wherein each cutter assembly has a leading side face, a trailing side face and an outer face between the leading and trailing side faces, the extremities of the exposed faces of the cutters are set back from the leading face, and the gauge surface extends forwardly to the leading side face.

15. The reaming tool of claim 12 wherein the plurality of cutters on each cutter assembly are a single sequence of cutters spaced axially along the assembly with each cutter alongside an adjacent cutter of the sequence.

16. The reaming tool of claim 12 wherein the radially outward extremities of at least some cutters are surface areas extending parallel to the tool axis.

17. A method of enlarging a borehole by rotating a reaming tool as defined in claim 1 in the borehole and advancing the tool axially.

* * * * *